United States Patent [19]

Knight

[11] 4,093,943

[45] June 6, 1978

[54] SEQUENTIAL POWER DISTRIBUTION CIRCUIT

[76] Inventor: Webster B. Knight, 2320 Abbey - No. 6, Fort Wayne, Ind. 46815

[21] Appl. No.: 754,103

[22] Filed: Dec. 27, 1976

[51] Int. Cl.[2] ..... G08B 17/10

[52] U.S. Cl. ..... 340/220; 250/574; 340/237 S; 362/227

[58] Field of Search ..... 340/237 S, 220; 250/574; 240/2 R, 2 S

[56] References Cited

U.S. PATENT DOCUMENTS

| | | | |
|---|---|---|---|
| 3,655,289 | 4/1972 | Walker | 250/574 X |
| 3,717,862 | 2/1973 | Sasaki | 340/237 S |
| 3,774,186 | 11/1973 | Enemark | 340/237 S |
| 4,004,288 | 1/1977 | Webb, Jr. | 340/237 S |

*Primary Examiner*—John W. Caldwell, Sr.
*Assistant Examiner*—Daniel Myer
*Attorney, Agent, or Firm*—Gust, Irish, Jeffers & Rickert

[57] ABSTRACT

A primary load, such as a conventional household light bulb, is series connected to a power source, such as is provided to a conventional household outlet. The conventional light switch is replaced by a circuit series connected to the source and lamp and draws relatively low operating power through the primary load. The circuit has an energy storage capacitor and a diode. A secondary load, such as an alarm, is coupled across the capacitor through an SCR (Silicon Controlled Rectifier). A sensing circuit, such as a smoke detector, is also connected across the capacitor and connected to the gate of the SCR and triggers the SCR upon detection of an alarm condition. A timing circuit is coupled between the SCR output and the diode to intermittently control the light bulb operation at a predetermined frequency upon smoke detection or other alarm. A dimmer circuit is provided for energizing the primary load at reduced power levels during periods of nonalarm and for intermittently energizing the primary load at full power, bypassing the detection circuit. Switch means are provided for selectively placing in the circuit a neon night light or the dimmer circuit during alarm for the primary load.

20 Claims, 2 Drawing Figures

SEQUENTIAL POWER DISTRIBUTION CIRCUIT

BACKGROUND OF THE INVENTION

1. Field of the Invention

This invention is in the field power distribution circuits and more particularly circuits which are adaptable to existing circuits for sensing and warning applications.

2. Description of Prior Art

Numerous systems have been designed for providing power for a secondary load, which typically may be an alarm system for smoke, heat, fire, or intrusion detection, as well as other detection functions and automatic correction functions, but these previous systems largely required their own power systems. In addition, active sensor systems having a constant power application to provide a more reliable and instantaneous operation are advantageous but due to the additional complexity and increased power consumption have been limited in their use. Further, alarm systems are preferably audio-visual and as such have required separate audio alarm means, such as a speaker and speaker drive circuit, and a separately wired and actuated light source, and generally relatively large power supplies, limiting the use of such alarm systems due to the expense of extensive installation and equipment cost. The need has existed for a compact power distribution system which takes full advantage of existing power wiring, existing components for the alarm, and provides an active sensor system, all at a minimum of installation cost, component cost, and power consumption cost. This invention fills this need to an extent not heretofore possible.

SUMMARY OF THE INVENTION

A primary load, such as a household lighting fixture, is coupled to a conventional household AC power source through the usual wall switch terminals. The conventional switch is removed and in its place is a circuit which may have a first module having componentry, having all of the high voltage components, and is easily placeable in the switch box. A second module, including the sensor circuit, may be pluggable through the switch plate to the first module. This second circuit has an energy reserve device, such as a capacitor, and a diode which acts as a protective and an energy reserve retention component and has only low voltage and low current used therein. Alternatively, the circuit may be in one module placed on the switch terminal box with the sensors being located advantageously in sensor detection areas. Placed across the capacitor is a second protective diode, and a sensor logic circuit which is adapted to receive a signal from externally placed sensors for smoke, fire, heat, intrusion, or the like. The logic circuit has an output connected to the gate of a silicon controlled rectifier which is placed across the capacitor in a circuit having leads adapted for attachment to a secondary load such as an audible alarm or automatic signaling device. Upon receiving a trigger signal from the sensor logic circuit, the SCR is caused to conduct and receives power alternately from the household power source and the energy reserve on the capacitor to maintain conduction once triggered. A reset switch is shunt mounted across the SCR and a momentary closing of the switch will reset or turn off the SCR, provided that the sensor logic circuit is no longer receiving an alarm condition signal from its sensors. Also, closing of the reset switch simulates an alarm condition for alarm circuit testing which intermittently closes, at an adjustable period, a relay switch controlling the primary load or household lamp thus providing the lamp with intermittent full power source voltage to provide a visual alarm signal. The relay switch is coupled to the gate of a triac which is connected to the wall switch terminals so that the household lamp will be flashed during time of alarm. Further, with additional diode capacitances coupled between the cathode of the first diode and the triac gate, a dimmer circuit for the household lamp is provided. Thus, a conventional household lamp is operated at a power level less than its rated level during normal usage greatly prolonging its life. When an alarm condition exists, the dimmer circuitry is bypassed and the lamp is then flashed at full power rating making the warning signal more noticeable.

This invention has many applications where power distribution for operating any one of a plurality of secondary loads are required wherein minimized power consumption, componental requirements and installation cost in a system using existing power, terminals and housings are desirable. The primary, existing, power source is used to full advantage as are the primary existing loads coupled in that power source. During an alarm condition, full primary supply voltage is applied sequentially to the primary and/or secondary loads, with a secondary energy reserve and sensing components being supplied during alternate sequential primary voltage periods. This invention can be used in parallel or series circuits; can be used in either AC or DC circuits; can apply full primary source voltage to a primary load in one period and operates one or more secondary loads, including sensor logic systems sensitive to smoke, heat, light, radio, sound, and other energy signals; has low power consumption; minimized additional wiring and terminal requirements; is adaptable to battery operation and for connection to a battery charger circuit; is usable with any existing switch using in common the existing terminals, wiring, and switch housings; and minimizes the installation, equipment, and power requirements.

Therefore, it is an object of this invention to provide a power distribution circuit which is capable of using existing terminals, wiring, and housings and operates from the existing power supplies.

A further object of this invention is to provide connections to sensing and alarm systems using the circuitry of the foregoing object.

Another object of this invention is to provide additional non-alarm functions with the addition of minimum circuitry and installation requirements.

The above-mentioned and other features and objects of this invention and the manner of attaining them will become more apparent and the invention itself will be best understood by reference to the following description of an embodiment of the invention taken in conjunction with the accompanying drawings.

DESCRIPTION OF A PREFERRED EMBODIMENT

Figure 1:
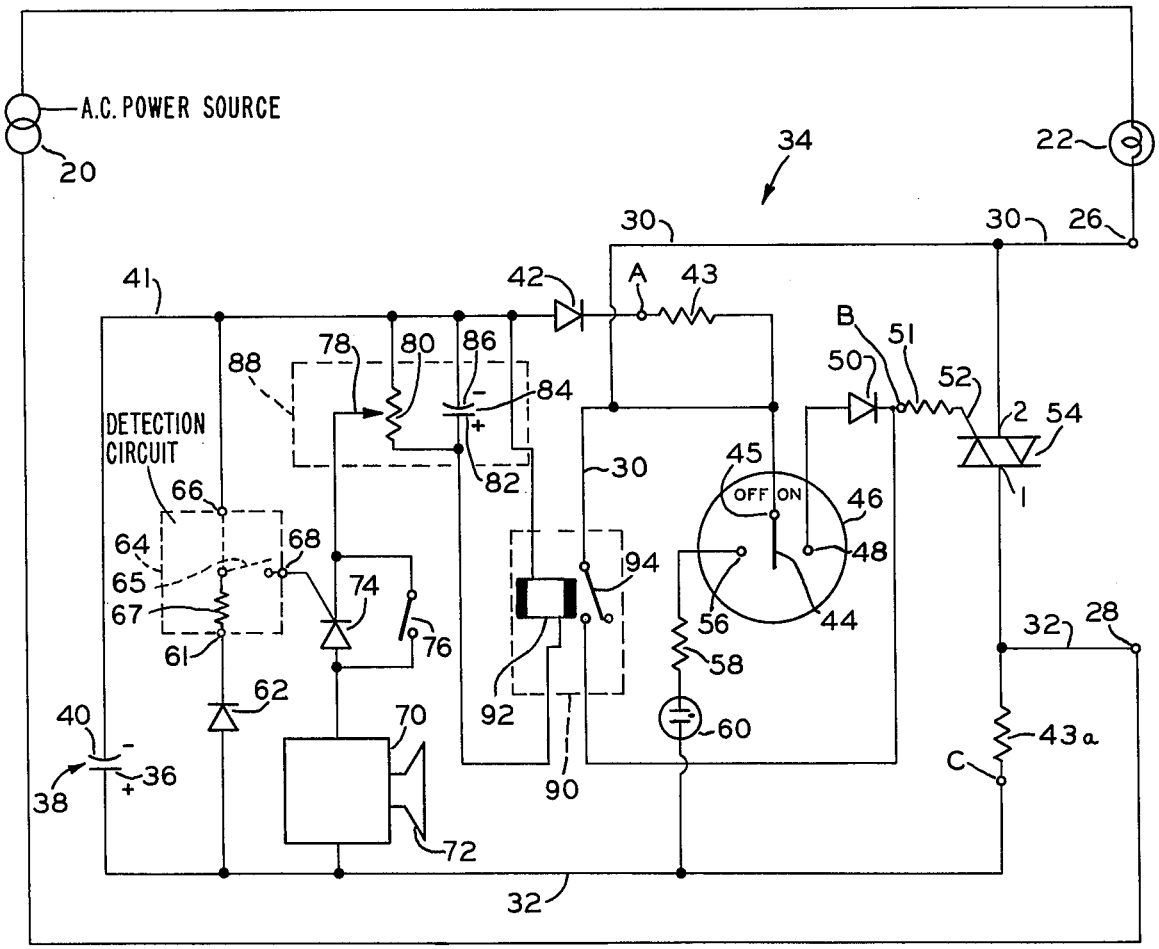
FIG. 1 is a circuit-block diagram of a preferred embodiment of this invention.

Referring to the drawing a circuit adapted for AC power supply operation is shown. A conventional household 120 volt 60 hz. power source 20 is shown in series connection with a conventional household lamp 22, the primary load. Lamp 22 is connected between terminal 26 and one side of source 20, with terminal 28 being connected to the other side of source 20. Terminals 26, 28 are located in a conventional switch box, not shown, and the conventional wall switch is removed. Lines 30, 32 of power distribution circuit 34 are connected respectively to terminals 26 and 28. It is seen that circuit 34 is series connected between terminals 26 and 28 and draws its power through load 22. Positive plate 36 of energy reserve capacitor 38 is connected to line 32 and negative plate 40 of capacitor 38 is connected to line 41 which is connected to the anode of a diode 42, which as will become apparent, isolates plate 40 from positive half cycles on line 30 from source 20. The cathode of diode 42 is connected to a terminal A. A resistance 43 is connected between terminal A and the switch blade 44 of a single pole double-throw switch 46. A resistance **43*a* is placed in line 32 between a terminal C and terminal 28. Resistances 43 and 43*a* are selected to limit the current flow and power consumption of the circuit to a relatively low value such as 20 milliamps, and places line 41** at approximately 30 V.D.C.

Switch terminal 48 of switch 46 is connected to the anode of diode 50 which has its cathode connected through a terminal B and resistance 51 to gate 52 of a triac 54, which is a solid state switch which may be gated "on" with signals of positive or negative polarity. It is important that triac 54 is connected so that main electrode 2 of the triac is connected to line 30 and main electrode 1 is connected to line 32. When switch blade 44 is connected to terminal 48, a "dimmer" illumination of lamp 22 exists. One terminal of triac 54 is connected to line 30 and the other terminal is connected to line 32. Terminal 56 of switch 48 is connected to one terminal of resistance 58 which has its other terminal connected to one terminal of neon light 60 which has its other terminal connected to line 32.

A diode 62 has its anode connected to line 32 and its cathode connected to one terminal of a sensor logic circuit 64 which has its other terminal connected to line 41. Diode 62 protects the circuit in the event of diode 42 failure. Circuit 64 may be any of suitable sensing circuits which can sense in one or more locations smoke, heat, intrusion, radiation, vibration, electrical circuit abnormality, or other sensed functions, and may be located remotely from circuit 34 in an area to be protected. A switch 65 is shown schematically which would close when a predetermined condition is sensed, but would otherwise be normally open. A signal is provided at terminal 68 of circuit 64 upon the sensing of a predetermined condition by circuit 64. Resistance 67 depicts a load in circuit 64. Circuit 64 may also sense weather alert or civil defense alert signals to automatically energize the alarm and/or a radio which will broadcast to the house occupants the alert signal.

A secondary load 70, in this embodiment an audible alarm having a speaker 72, has one terminal connected to line 32 and a second terminal connected to the anode of an SCR (silicon controlled rectifier) 74. The alarm 70 would be placed, in the usual circumstance, remotely from circuit 34 in an area or areas where it was desired an alarm would be given, or corrective action would automatically be taken, for the condition sensed by circuit 64. A manual reset switch 76 is connected across SCR 74 and is normally in the open position as shown.

The cathode of SCR 74 is connected to pointer 78 which is manually slidable along a resistance 80 having one terminal connected to line 41 and a second terminal connected to the positive plate 82 of capacitor 84. The negative plate 86 of capacitor 84 is connected to line 41. Resistance 80 and capacitor 84 are part of a timing logic circuit 88 which provides a time delay, adjustable by movement of pointer 78 along resistance 80. Relay 90 has a coil 92 with one terminal connected to line 41 and the other terminal connected to plate 82 of capacitor 84. Relay switch 94 is placed in close proximity to coil 92 and is closed upon a predetermined voltage such as 4 volts across coil 92 and opens when the voltage across coil 92 drops to a second predetermined level such as 2 volts. One terminal of switch 94 is connected to line 30 and pole 45 of switch 46, and the other terminal of switch 94 is connected through resistance 51 to gate 52 of triac 54. As will become apparent, relay 90 acts as a threshold device which closes only when a predetermined voltage is present. Other threshold devices such as a LED-phototransistor may be used in conjunction with relay 90 to aid in determining the voltage threshold on capacitor 84 before discharge through coil 92.

In the operation of the embodiment shown in the drawing, assuming that AC power source 20 has gone through a full cycle of operating, plate 36 of capacitor 38 will be charged positively and plate 40 will be charged negatively. On a forward current half cycle, a positive voltage is applied to terminal 28 and line 32, and a negative voltage is applied to terminal 26 and line 30, causing diode 42 to conduct and a positive charge will be applied to plate 36 of capacitor 38 and a negative charge will be applied to plate 40. On a reverse current half cycle, with a negative voltage applied to terminal 28 and line 32, and a positive voltage applied to terminal 26 and line 30, diode 42 will not conduct and the aforementioned charge will be held on the plates of capacitor 38. On each forward current half cycle, capacitor 38 will be recharged to replenish any charge dissipation of capacitor 38 and diode 42 will prevent a discharge of capacitor 38 on a reverse current half cycle from source 20. Therefore, a positive voltage is applied to the anode of diode 62 and to the anode of SCR 74, through alarm 70, during both the forward and reverse current half cycles of source 20.

Assuming that circuit 64 detects a dangerous condition, such as smoke, heat, intrusion, or the like, switch 65 is closed completing a circuit between the cathode of diode 62 and line 41. Diode 62 will conduct placing a trigger voltage at terminal 68 and the gate of SCR 74 causing SCR 74 to fire. Alarm 70 will then be actuated since a circuit will be completed between line 32 and line 41 through SCR 74, pointer 78, and resistance 80. This alarm will be continuous since on a forward current half cycle, a positive voltage from terminal 28 through line 32 will flow through alarm 70, SCR 74, pointer 78, resistance 80 to the anode of diode 42 and to line 30 through light 22 to source 20. At the same time, a positive voltage will be applied to the anode of diode 62 causing it to conduct, maintaining a trigger voltage at output 68 and maintaining SCR 74 in conduction. On a reverse current half cycle, the positive charge from plate 36 of capacitor 38 will likewise maintain diode 62 and SCR 74 in conduction, although at a lower level.

During this "sensed" condition, plate 82 of capacitor 84 will become positively charged and plate 86 will become negatively charged with the period of charging being dependent upon the position of pointer 78 on resistance 80 and determines the alarm frequency of the circuit. When capacitor 84 has been charged to a voltage sufficient to energize coil 92, relay switch 94 closes. Once switch 94 has closed, a current path will be established between line 30 and gate 52 of triac 54 turning "on" triac 54 causing a full wave 120 volt signal between terminals 26 and 28 causing a corresponding full illumination of lamp 22 and shunting the remaining circuit 34 componentry thus increasing the effective voltage across lamp 22. This will occur for both forward and reverse current half cycles of source 20 since either a plus or minus voltage on gate 52 will cause triac 54 to conduct. Thus, light 22 will alternate between full illumination and non-illumination, or between full illumination and dimmer illumination if blade 44 is contacting terminal 48, during an alarm condition thus providing a visual alarm to the house occupants, or, depending on the number of and location of lamps 22, a visual alarm could be presented exteriorly of the premises providing a signal for help and flash the porch or post light as a locating beacon for fire, police, or other emergency aid. This invention, when used with a lamp post having a photocell control, overrides the photocell in day light hours to provide an intermittent flashing of the post lamp at the alarm frequency. After plate 82 has sufficiently discharged through coil 92 and SCR 74, the voltage across coil 92 will fall below that required to hold in switch 94. Since AC triac 54 is conducting, allowing primary lamp 22 to light, the saturation voltage of the triac is approximately 1 volt or less. This voltage is impressed at point 26 and 28 effectively short circuiting coil 92, at the same time impressing nearly all the source voltage of 20 across lamp 22. Also, as the current flow thru coil 92 decreases, it causes a counter EMF and coil current/voltage decay time is determined by resistance 80 and capacitor 84 discharge time. Switch 94 opens due to lack of coil voltage. Triac 54 turns off and points 26 and 28 are raised again to almost full line voltage of power source 20. Capacitor 84 now charges again to sufficient coil voltage to close switch 94 and sequential power distribution is accomplished. The period of alternation of lamp 22 illumination typically would be several seconds and is determined by the position of pointer 78 on resistance 80 and the threshold voltage at which switch 94 closes. Also, at the same time, an audible alarm from speaker 72 will be heard.

An important advantage of this circuit is its adaptability to a night light and dimmer switch capability with a minimum of added components. For night light operation, switch blade 44 of switch 46 is moved to terminal 56 thus connecting line 30 to resistance 58 and neon night light 60 completing a circuit with power source 20 through line 32. Light 60 and switch 46 may be located conveniently in the housing for circuit 34 or other desired locations. Light 60 will be illuminated continuously, when blade 44 is connected to terminal 56, but during an alarm condition, switch 94 and triac 54 shunt lamp 60 causing it to be extinguished. Alternatively, blade 44 may be switched to terminal 48 thus connecting line 30 to the anode of diode 50 and during positive voltage from source 20 to terminal 26, diode 50 will conduct applying a trigger voltage to gate 52 of triac 54 causing current flow through lamp 22. However, during negative voltage to terminal 26, diode 50 will be non-conductive and no trigger voltage will be applied to gate 52 and triac 54 will be non-conductive. Thus, lamp 22 will be intermittently illuminated at a 60 Hz. frequency thus providing a phase-controlled dimmer for lamp 22. In this manner, lamp 22 is illuminated at a predetermined fraction of its rated power, thus greatly prolonging its life. Lamps have lasted eight to 20 times their normal life expectancy. As an example, if lamp 22 is rated at 100 watts, it may be illuminated at 50 watts during normal operation but will be intermittently illuminated at 100 watts during alarm. If desired, the period during which diode 50 is conductive, and thus the fraction of their rated power capacity may be adjusted by means well known to the art to provide an adjustable dimmer control. Another significant advantage is that in the event of an alarm condition, the alarm signal will "override" the dimmer circuitry since when switch 94 is closed, and full voltage from line 30 bypasses diode 50 and is applied directly to gate 52 of triac 54 to illuminate lamp 22 at its full rated power capacity thus providing a brighter, intermittent lamp operation during alarm conditions.

After an alarm condition has subsided, SCR 74 will continue to conduct until reset switch 76 is momentarily closed which will discontinue conduction and discontinue alarm 70. The continued conduction until closure of switch 76 is a safety feature since once a dangerous condition has been sensed by sensor 64, a temporary cessation of that condition will not cause alarm 70 to stop. Also, switch 76 may be used to test the alarm circuitry by manual closing and this will simulate an alarm condition since the alarm circuitry will be closed as if SCR 74 were conducting.

Figure 2:
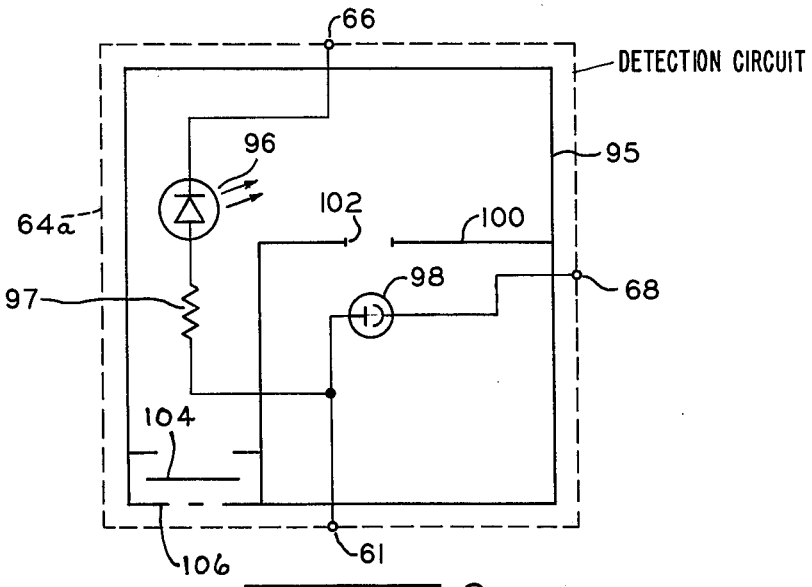
FIG. 2 is a diagram of a sensor usable in the circuit of FIG. 1.

Referring to FIG. 2, a particular smoke sensor device is shown. Sensor device 64*a*, which may be substituted for sensor 64 in the circuit of FIG. 1, comprises a light-tight box 95 in which is mounted a light emitting diode 96 having its anode connected through resistance 97 to terminal 61 and its cathode connected to terminal 66. A photocell 98 is in close proximity to diode 96 and has its anode connected to terminal 61 and its cathode connected to terminal 68. A baffle housing 100 having opening 102 encloses photocell 98. Diode 96 will be illuminated by the current flow through diode 62 which is continuous in the embodiment of FIG. 2, and the illumination reflected from any ambient smoke will enter opening 102 to cause photocell 98 to decrease its resistance causing a trigger signal to appear at terminal 68. A baffle plate 104 is spaced from the walls of box 95 and perforated bottom 106 and will allow smoke to enter box 95 but will prevent light entrance. However, during absence of ambient smoke, the light transmissivity in the path between diode 96 and photocell 98 will be at a minimum and the resistance of photoconductor 98 will be correspondingly high preventing any current flow and preventing an alarm trigger signal at terminal 68 which will prevent SCR 74 from conduction. Also, sensor 64 may comprise a receiver which can be actuated by an emergency radio wave signal transmitted by a governmental or local commercial radio station to cause an alarm and at the same time automatically energize a speaker for broadcasting the emergency details. Also, if desired, circuit 34 may be formed in two modules which have conventional plug connections at terminals A, B, and C. The first module would have the high voltage components and the second module would have relatively low voltage components, thereby affording lower power rated wiring and components and protecting the user from high voltage shock. Resistances 43, 43*a*, and 51 provide voltage drops and lower voltages to the connection terminals A, B, and C.

In a working embodiment the following values have been found to be satisfactory:

| Reference Numeral | Component Value |
|---|---|
| (Resistances) | |
| 43 | 1.5 K ohms 2 watt |
| 43a | 1.5 K ohms 2 watt |
| 51 | 10 K ohms |
| 58 | 150 K ⅛ watt |
| 80 | 5 K Potentiometer |
| 97 | 2 K ohms |
| (Capacitance) | |
| 38 | 100 mfd. 50 volts |
| 84 | 100 mfd. 25 volts |
| (Diodes) | |
| 42 | IN 629 200 volts |
| 50 | IN 881 Low Leakage 200 volts |
| (Transformer) | |
| 70 | Calectro DI724 |
| (SCR) | |
| 74 | 6 CU. 25 volts 30–70 UA Gate |
| (Relay) | |
| 90 | Zestron 270-4-1A 4 volts 500 ohm |
| (Neon Light) | |
| 60 | NE 2 |
| (Triac) | |
| 54 | ECG 5614 Sylvania 200–300 volts |
| (or) | SC240B GE 200–300 volts |
| (Light Emitting Diode) | |
| 96 | Hewlett Packard 5082-4658 |
| (Photocell) | |
| 98 | Clairex CL904L |

While there have been described above the principles of this invention in connection with specific apparatus, it is to be clearly understood that this description is made only by way of example and not as a limitation to the scope of the invention.

What is claimed is:

1. A power distribution circuit comprising; a power source; a primary load being coupled to and selectively energizable by said source;

an energy reserve having a predetermined reserve capacity;

first means for coupling said source to said reserve to provide said reserve with a flow of energy with the flow and accumulation of said flow being limited by said capacity when said load is not being energized;

second means for retaining said energy in said reserve when said load is being energized by said source;

a secondary load being coupled to the energy in said reserve;

third means coupled to said reserve for generating a signal upon the sensing of a predetermined condition;

fourth means coupled to said reserve and secondary load and operable by said signal and said reserve for power coupling said secondary load to said power source upon generation of said signal.

2. The device of claim 1 including fifth means for applying a partial power of said power source to operate said primary load during periods when said predetermined condition is not sensed.

3. The device of claim 2 wherein said third means is continuously provided with power from said reserve;

sixth means coupled to and operable by said third means signal for intermittent power coupling of said primary load to said power source and for bypassing said fifth means upon sensing by said third means of said predetermined condition.

4. The device of claim 3 including seventh means for controlling the period of intermittency of said sixth means.

5. The device of claim 2 including eighth means for selectively providing illumination;

ninth means for manual switching between said fifth means and said eighth means.

6. A power distribution circuit comprising; a power source circuit having a power source; a lamp series coupled to said power source; a first terminal series coupled to said lamp and a second terminal series coupled to said source; a first capacitor and a first diode having an anode and cathode; a first resistance being coupled in series to said cathode; said first capacitor, first diode, and first resistance being coupled in series between said first and second terminals; said diode conducting in a first direction; a sensor circuit being connected in shunt across said capacitor; said sensor circuit having a trigger terminal; an alarm circuit and a series connected silicon controlled rectifier having a gate electrode and a series connected second resistance being connected in shunt across said capacitor and in series with said diode; said rectifier conducting in said first direction; said trigger terminal being connected to said gate electrode; a second capacitor being connected across said resistance; a relay coil being connected across said second capacitor; said coil operable to close a relay switch; a triac being connected between said first and second terminals; said triac having a gate electrode, a third resistance being connected to said triac gate electrode; said switch being connected between said third resistance and said first terminal.

7. The device of claim 6 including a single pole double-throw switch having a pole and first and second switch contacts and having its pole connected to said first resistance; a fourth resistance and neon light series connected between said second terminal and said first contact; a third diode having an anode and cathode; said third diode cathode being connected to said triac gate and said third diode anode being connected to said second contact.

8. The device of claim 6 including a manually operated switch being connected across said rectifier.

9. The device of claim 6 wherein said alarm circuit is an audio alarm.

10. A warning system comprising:

a power source having a given power capacity; a primary load;

first means for detecting a warning condition;

second means coupled to said power source and said primary load for applying an operating level of said power capacity to said primary load to operate said load at a first operating level in the absence of a warning condition detection by said first means;

third means coupled to said primary load, said first means and said power source for applying a higher level of said power capacity than said operating level to said primary load upon detection by said first means of a warning condition to operate said load for warning purposes at a higher operating level than said first level.

11. The device of claim 10 including fourth means coupled to said third means for applying said higher level of power capacity intermittently to said primary load.

12. The device of claim 10 including a secondary load; fifth means coupled to said secondary load, said second means, and said power source for energizing said secondary load upon detection by said second means of a warning condition.

13. The device of claim 12 including fourth means coupled to said second means, said fifth means, and said second load for applying said higher level of power capacity intermittently to said primary load.

14. A power distribution system adaptable to replace an electrical switch in a circuit having an electrical power source and an illuminating load coupled in power receiving relation to said source and controllable through said switch, said load having a predetermined operating power capacity and decoupled from the power source by switch removal from said source comprising an alarm circuit in switch replaceable relation to said load and in series with said load and power source wherein said alarm circuit receives operating power through said load; said alarm circuit having an alarm detection condition and a non-alarm detection condition.

15. The device of claim 14 wherein said circuit comprises means for applying operating power to said load during a non-alarm condition to a first level below said predetermined capacity thereby substantially increasing the life of said load.

16. The device of claim 15 wherein said circuit comprises means for increasing the operating power to said load to a level higher than said first level.

17. The device of claim 14 wherein said power source operates at a predetermined effective voltage; including first means for reducing the circuit operating effective voltage to a level substantially less than the power source effective voltage during non-alarm condition;

means for switching the power source to and from said first means.

18. The system of claim 14 wherein said alarm circuit has means for operating said load in an alarm mode which is visually distinguishable from the non-alarm mode operation of said load.

19. The device of claim 18 wherein said last means is for actuating said load continuously during non-alarm detection condition and intermittently during alarm detection condition.

20. The device of claim 18 wherein said last means is for actuating said load at a first brightness intensity level during a non-alarm condition and at a higher level during an alarm detection condition.

* * * * *

UNITED STATES PATENT OFFICE

CERTIFICATE OF CORRECTION

Patent No. 4,093,943 Dated June 6, 1978

Inventor(s) Webster B. Knight

It is certified that error appears in the above-identified patent and that said Letters Patent are hereby corrected as shown below:

In the Abstract

Line 20, after "circuit" insert -- during alarm --.

Line 22, after "circuit" delete -- during alarm --.

Column 4, line 26, "operating" should read -- operation --.

Column 9, line 5, "second" should read -- secondary --.

Signed and Sealed this

Ninth Day of January 1979

[SEAL]

Attest:

RUTH C. MASON
Attesting Officer

DONALD W. BANNER
Commissioner of Patents and Trademarks